US010845018B1

(12) United States Patent
Ueno

(10) Patent No.: US 10,845,018 B1
(45) Date of Patent: Nov. 24, 2020

(54) VEHICLE LUMINAIRE AND VEHICLE LAMP

(71) Applicant: Toshiba Lighting & Technology Corporation, Yokosuka (JP)

(72) Inventor: Misaki Ueno, Yokosuka (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 0 days.

(21) Appl. No.: 16/793,563

(22) Filed: Feb. 18, 2020

(30) Foreign Application Priority Data

May 29, 2019 (JP) ..... 2019-100327

(51) Int. Cl.
*F21S 41/19* (2018.01)
*F21S 41/25* (2018.01)

(52) U.S. Cl.
CPC ..... *F21S 41/194* (2018.01); *F21S 41/25* (2018.01)

(58) Field of Classification Search
CPC ..... F21S 41/194; F21S 41/25; F21S 41/141; F21S 41/47; F21S 41/19
See application file for complete search history.

(56) References Cited

U.S. PATENT DOCUMENTS 9,970,622 B2 5/2018 Helbig et al.
2015/0016136 A1 1/2015 Nakano et al.
2016/0185281 A1* 6/2016 Kaneko ..... F21S 41/19 362/547
2018/0073714 A1 3/2018 Ozawa et al.
2019/0267518 A1 8/2019 Hino et al.

FOREIGN PATENT DOCUMENTS

| | | | |
|---|---|---|---|
| CN | 208750635 | U | 4/2019 |
| DE | 202014002809 | U1 | 4/2014 |
| DE | 102015206471 | A1 | 10/2016 |
| EP | 3279552 | A1 | 2/2018 |
| EP | 3441666 | A1 | 2/2019 |
| JP | 2013-247062 | A | 12/2013 |

* cited by examiner

*Primary Examiner* — Anabel Ton
(74) *Attorney, Agent, or Firm* — Banner & Witcoff, Ltd.

(57) ABSTRACT

A vehicle luminaire according to an embodiment includes: an attachment portion which includes a concave portion; a light-emitting module which includes a substrate, at least one light-emitting element provided in the substrate, and a sealing portion covering the light-emitting element; and a plurality of bayonets which are provided on an outer side surface of the attachment portion. The attachment portion includes at least one light extraction portion which penetrates between an inner wall surface of the concave portion and the outer side surface of the attachment portion. In a portion provided with the bayonet in a circumferential direction of the attachment portion, a distance between a bottom surface of the concave portion and an end portion on the side of the bottom surface of the light extraction portion is smaller than a distance between the bottom surface and a top portion of the sealing portion.

21 Claims, 6 Drawing Sheets

VEHICLE LUMINAIRE AND VEHICLE LAMP

CROSS-REFERENCE TO RELATED APPLICATIONS

This application is based upon and claims the benefit of priority from Japanese Patent Application No. 2019-100327, filed on May 29, 2019; the entire contents of which are incorporated herein by reference.

FIELD

Embodiments described herein relate generally to a vehicle luminaire and a vehicle lamp.

BACKGROUND

A vehicle luminaire including a socket and a light-emitting module provided in one end portion side of the socket is known. The light-emitting module is provided with a substrate and one surface of the substrate is provided with a light-emitting element, a resistor and other components. In such a vehicle luminaire, the light-emitting module is provided inside a concave portion opening to an end face of the socket. For that reason, the light-emitting module is surrounded by an inner wall surface of the concave portion and a part of light emitted from the light-emitting element is incident on the inner wall surface of the concave portion. Since a part of the light incident on the inner wall surface of the concave portion is absorbed by the inner wall surface, light extracting efficiency is deteriorated by the corresponding amount.

Here, a technique of forming a slit in an inner wall surface of a concave portion and accommodating a corner portion of a substrate inside the slit is proposed. Since there is no inner wall surface of the concave portion in a portion provided with the slit, light applied to this portion is not absorbed by the inner wall surface. However, since the slit is used to position the substrate, its width dimension needs to be small. For that reason, the light extracting efficiency cannot be improved in the slit provided in the inner wall surface of the concave portion.

Here, it is desired to develop a technique capable of improving the light extracting efficiency.

DETAILED DESCRIPTION

Figure 1:
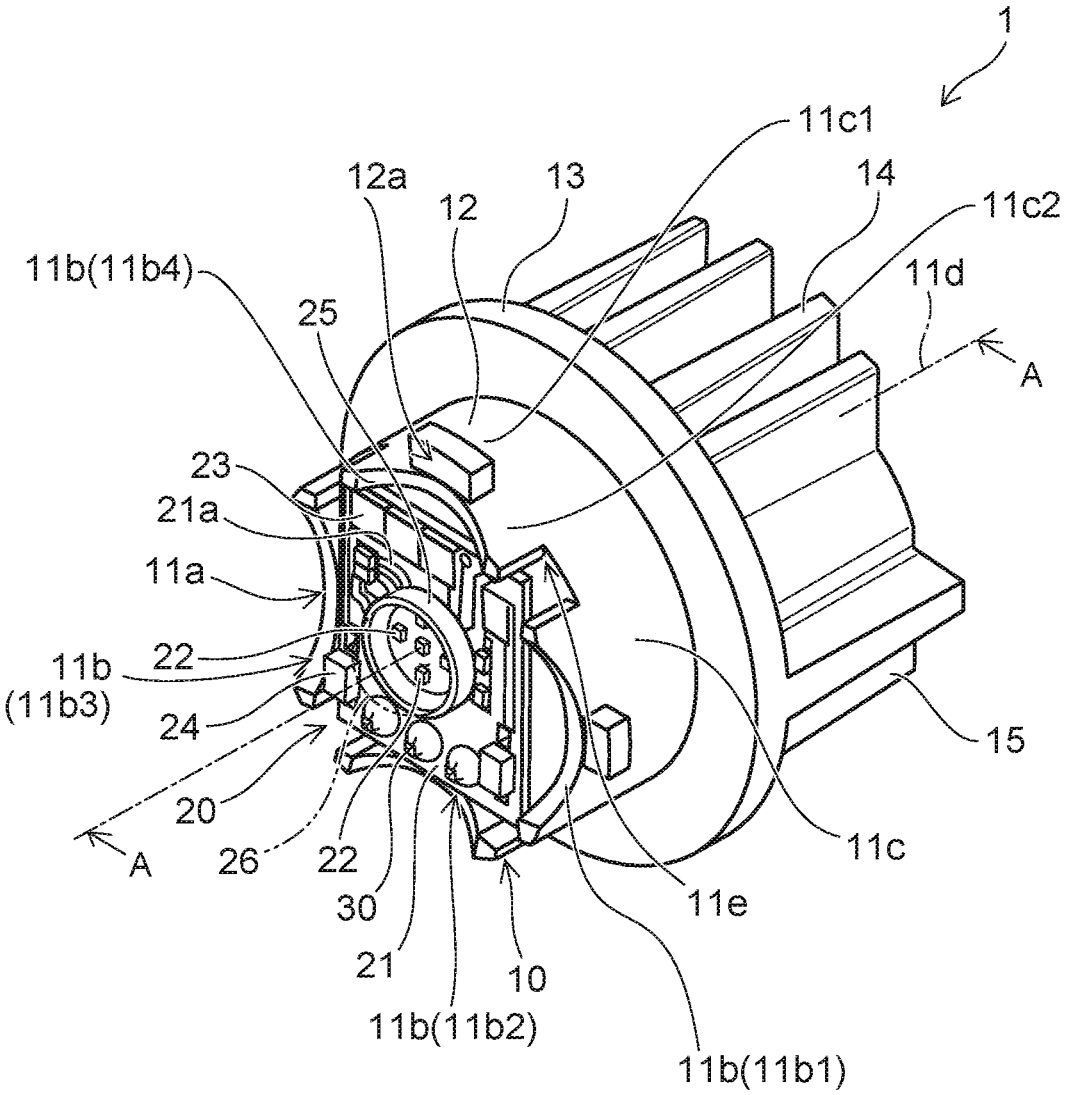
FIG. 1 is a schematic perspective view illustrating a vehicle luminaire according to an embodiment.

A vehicle luminaire according to an embodiment includes: an attachment portion which includes a concave portion opening to one end face; a light-emitting module which includes a substrate, at least one light-emitting element provided in the substrate, and a sealing portion covering the light-emitting element and is provided inside the concave portion; and a plurality of bayonets which are provided on an outer side surface of the attachment portion. The attachment portion includes at least one light extraction portion which penetrates between an inner wall surface of the concave portion and the outer side surface of the attachment portion. In a portion provided with the bayonet in a circumferential direction of the attachment portion, a distance between a bottom surface of the concave portion and an end portion on the side of the bottom surface of the light extraction portion is smaller than a distance between the bottom surface and a top portion of the sealing portion.

Hereinafter, embodiments will be illustrated with reference to the drawings. Additionally, in the drawings, the same elements will be denoted by the same reference numerals and a detailed description thereof will be appropriately omitted.

(Vehicle Luminaire)

A vehicle luminaire 1 according to the embodiment can be provided in, for example, automobiles and railway cars. As the vehicle luminaire 1 provided in automobiles, for example, one used in a front combination light (for example, an appropriate combination of a daytime running lamp (DRL), a position lamp, a turn signal lamp, and the like) or a rear combination light (for example, an appropriate combination of a stop lamp, a tail lamp, a turn signal lamp, a back lamp, a fog lamp, and the like) can be illustrated. However, the application of the vehicle luminaire 1 is not limited to these.

FIG. 1 is a schematic perspective view illustrating the vehicle luminaire 1 according to the embodiment.

Figure 2:
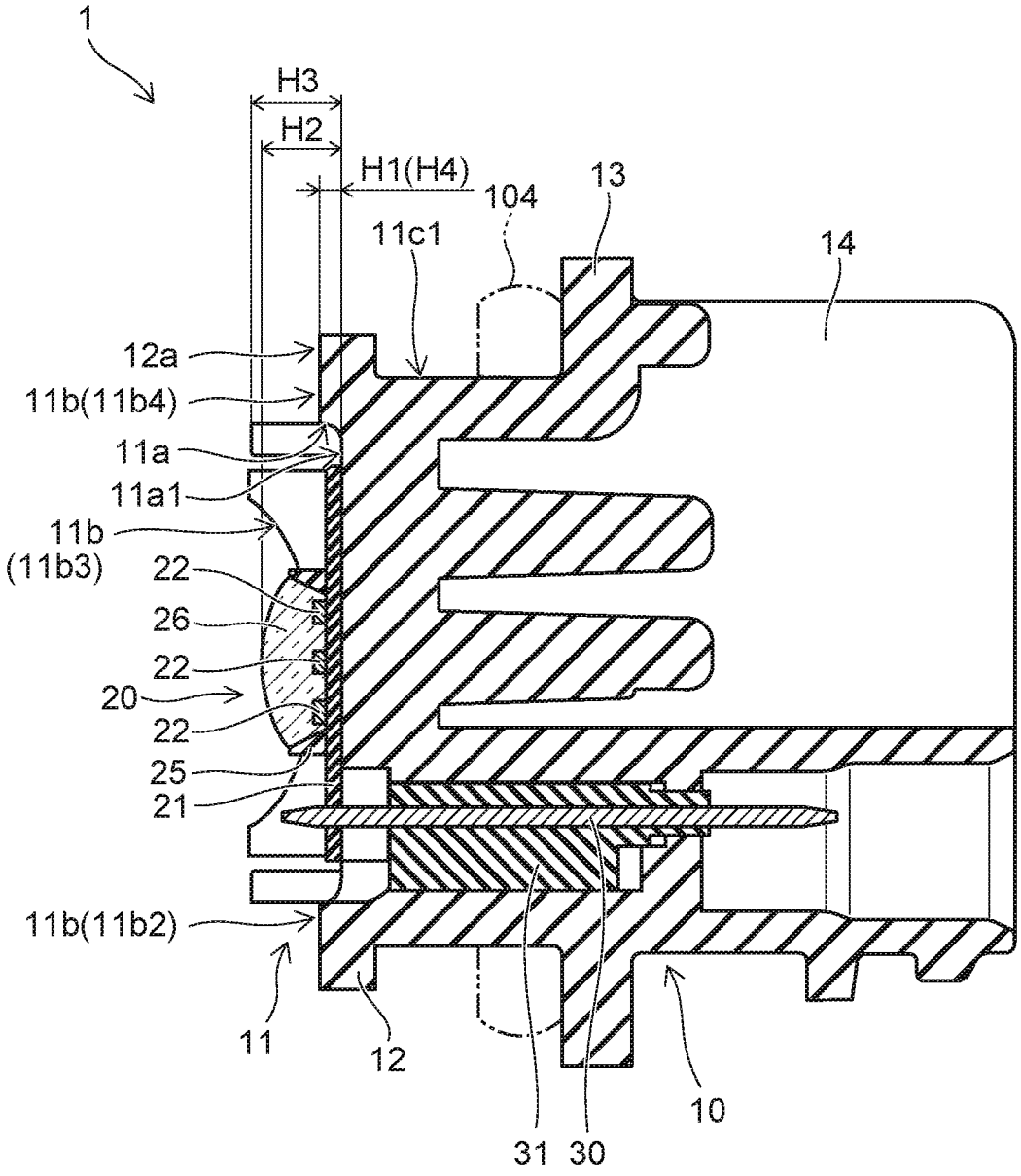
FIG. 2 is a cross-sectional view taken along a line A-A of the vehicle luminaire.

FIG. 2 is a cross-sectional view taken along a line A-A of the vehicle luminaire 1 of FIG. 1.

As illustrated in FIGS. 1 and 2, the vehicle luminaire 1 can be provided with a socket 10, a light-emitting module 20, and a power-supply terminal 30.

The socket 10 can be provided with an attachment portion 11, a bayonet 12, a flange 13, a thermal radiation fin 14, and a connector holder 15.

The attachment portion 11 can be provided on one surface of the flange 13. The external shape of the attachment portion 11 can be a pillar shape. The external shape of the attachment portion 11 can be, for example, a columnar shape. The attachment portion 11 can include a concave portion 11*a* opening to an end face opposite to the flange 13.

The attachment portion 11 can be provided with a light extraction portion 11*b*. The light extraction portion 11*b* can penetrate between an inner wall surface of the concave portion 11*a* and an outer side surface 11*c* of the attachment portion 11. Further, the light extraction portion 11*b* can open to an end face opposite to the flange 13 in the attachment portion 11.

At least one light extraction portion 11*b* can be provided. However, it is easy to improve the light extracting efficiency when the plurality of light extraction portions 11*b* are provided. The light extraction portion 11*b* can be provided in, for example, each of the plurality of bayonets 12. That is, the light extraction portion 11*b* can be provided in a region provided with the bayonet 12 in the circumferential direction of the attachment portion 11. The attachment portion 11 illustrated in FIG. 1 is provided with four light extraction portions 11*b*, that is, light extraction portions 11*b*1, 11*b*2, 11*b*3, and 11*b*4.

Additionally, the light extraction portion 11*b* will be described in detail later.

Further, the attachment portion 11 can be provided with at least one slit 11*e*. A corner portion of the substrate 21 can be provided inside the slit 11*e*. The dimension (width) of the slit 11*e* of the attachment portion 11 in the circumferential direction can be slightly larger than the dimension of the corner portion of the substrate 21. In this way, the substrate 21 can be positioned by inserting the corner portion of the substrate 21 into the slit 11*e*.

Further, when the slit 11*e* is provided, the planar shape of the substrate 21 can be enlarged. For that reason, it is possible to increase the number of elements mounted on the substrate 21. Alternatively, since it is possible to decrease the external shape dimension of the attachment portion 11, it is possible to decrease the size of the attachment portion 11 and to further decrease the size of the vehicle luminaire 1.

When the attachment portion 11 is viewed from a direction along a center axis 11*d* of the attachment portion 11, a plurality of bayonets 12 can be provided at a predetermined interval. The bayonet 12 can be provided at a plurality of positions of the outer side surface 11*c* of the attachment portion 11. The plurality of bayonets 12 can protrude toward the outside of the vehicle luminaire 1. The plurality of bayonets 12 can face the flange 13. The plurality of bayonets 12 can be used when attaching the vehicle luminaire 1 to a casing 101 of a vehicle lamp 100. The plurality of bayonets 12 can be used for twist lock.

The flange 13 can have a plate shape. For example, the flange 13 can have a disk shape. The outer side surface of the flange 13 can be located at the outside of the vehicle luminaire 1 in relation to the outer side surface of the bayonet 12.

The thermal radiation fin 14 can be provided on the side opposite to the attachment portion 11 in the flange 13. At least one thermal radiation fin 14 can be provided. For example, the socket 10 illustrated in FIGS. 1 and 2 is provided with a plurality of thermal radiation fins 14. The plurality of thermal radiation fins 14 can be provided side by side in a predetermined direction. The thermal radiation fin 14 can have a plate shape.

The connector holder 15 can be provided on the side opposite to the attachment portion 11 in the flange 13. The connector holder 15 can have a cylindrical shape. A connector 105 including a seal member 105*a* is inserted into the connector holder 15. For that reason, the cross-sectional shape of the hole of the connector holder 15 can be suitable for the cross-sectional shape of the connector 105 including the seal member 105*a*.

Heat generated in the light-emitting module 20 is mainly transmitted to the thermal radiation fin 14 through the attachment portion 11 and the flange 13. The heat transmitted to the thermal radiation fin 14 can be mainly discharged from the thermal radiation fin 14 to the outside. For that reason, the socket 10 is desirably formed of a material having high heat conductivity in consideration of the transmission of the heat generated in the light-emitting module 20 to the outside. The material having high heat conductivity can be, for example, metal such as aluminum.

Further, in recent years, a decrease in weight of the vehicle luminaire 1 is desired. For that reason, the socket 10 is desirably formed using a high thermal conductive resin. The high thermal conductive resin can be obtained by mixing a filler using an inorganic material with a resin such as polyethylene terephthalate (PET) or Nylon. The inorganic material can be, for example, ceramics such as aluminum oxide or carbon.

Further, a part of the elements constituting the socket 10 can be formed using metal and the remaining elements can be formed using a high thermal conductive resin.

However, when the socket 10 is formed using a high thermal conductive resin, heat generated in the light-emitting module 20 can be effectively radiated. Further, the weight of the vehicle luminaire 1 can be decreased. In this case, the attachment portion 11, the bayonet 12, the flange 13, the thermal radiation fin 14, and the connector holder 15 can be integrally formed using an injection-molding method or the like.

The light-emitting module 20 can be provided inside the concave portion 11*a*.

The light-emitting module 20 (substrate 21) can be bonded to the bottom surface 11*a*1 of the concave portion 11*a*. In this case, an adhesive is desirably an adhesive having high heat conductivity. For example, the adhesive can be an adhesive mixed with a filler using an inorganic material. The inorganic material is desirably a material having high heat conductivity (for example, ceramics such as aluminum oxide and aluminum nitride). The heat conductivity of the adhesive can be, for example, 0.5 W/(m·K) or more and 10 W/(m·K) or less.

Further, the light-emitting module 20 (the substrate 21) can also be provided on the bottom surface 11*a*1 of the concave portion 11*a* with a layer formed of thermal conductive grease (radiation grease) interposed therebetween. The type of thermal conductive grease is not particularly limited, but may be one obtained by mixing, for example, modified silicone with a filler using a material having high heat conductivity (for example, ceramics such as aluminum oxide or aluminum nitride). The heat conductivity of the thermal conductive grease can be, for example, 1 W/(m·K) or more and 5 W/(m·K) or less.

Further, a heat transfer portion can be provided between the light-emitting module 20 (the substrate 21) and the bottom surface 11*a*1 of the concave portion 11*a*. For example, the heat transfer portion can have a plate shape and be formed of metal such as aluminum, aluminum alloy, copper, and copper alloy. For example, the heat transfer portion can be bonded to the bottom surface 11*a*1 of the concave portion 11*a* using the adhesive having high heat conductivity, embedded in the bottom surface 11*a*1 of the concave portion 11*a* using an insert-molding method, or attached to the bottom surface 11*a*1 of the concave portion 11*a* through the thermal conductive grease.

The light-emitting module 20 can include a substrate 21, a light-emitting element 22, a resistor 23, and a control element 24.

The substrate 21 can have a plate shape. The planar shape of the substrate 21 can be, for example, a square. The material or structure of the substrate 21 is not particularly limited. For example, the substrate 21 can be formed of an inorganic material such as ceramics (for example, aluminum oxide or aluminum nitride) or an organic material such as paper phenol or glass epoxy. Further, the substrate 21 may be a metal plate of which a surface is coated with an insulating material. In addition, when the surface of the metal plate is coated with an insulating material, the insulating material may be an organic material or an inorganic material. When the amount of heat of the light-emitting element 22 is large, the substrate 21 is desirably formed using a material having high heat conductivity from the viewpoint of the heat radiation. As the material having high heat conductivity, for example, ceramics such as aluminum oxide and aluminum nitride, high thermal conductive resin, and a metal plate whose surface is coated with an insulating material can be illustrated. Further, the substrate 21 may have a single layer structure or a multilayer structure.

Further, a wiring pattern 21*a* can be provided on the surface opposite to the bottom surface 11*a*1 of the concave portion 11*a* in the substrate 21. The wiring pattern 21*a* can be formed of, for example, a material mainly including silver or a material mainly including copper.

The light-emitting element 22 can be provided on the substrate 21. The light-emitting element 22 can be electrically connected to the wiring pattern 21*a* provided on the surface of the substrate 21. At least one light-emitting element 22 can be provided. In the case of the vehicle luminaire 1 illustrated in FIG. 1, five light-emitting elements 22 are provided. When the plurality of light-emitting elements 22 are provided, the plurality of light-emitting elements 22 can be connected in series to each other. Further, the light-emitting element 22 can be connected in series to the resistor 23.

The light-emitting element 22 can be, for example, a light-emitting diode, an organic light-emitting diode, a laser diode, or the like.

The light-emitting element 22 may be a chip-shaped light-emitting element, a surface mounted light-emitting element, or a shell type light-emitting element having a lead wire. However, the chip-shaped light-emitting element is desirable in consideration of a decrease in size of the substrate 21 and further a decrease in size of the vehicle luminaire 1. Additionally, the light-emitting element 22 illustrated in FIGS. 1 and 2 is a chip-shaped light-emitting element.

The chip-shaped light-emitting element 22 can be mounted on the wiring pattern 21*a* by Chip On Board (COB). When the light-emitting element 22 is a light-emitting element of an upper and lower electrode type or a light-emitting element of an upper electrode type, the light-emitting element 22 can be electrically connected to the wiring pattern 21*a* by, for example, a wire bonding method. When the light-emitting element 22 is a flip chip type light-emitting element, the light-emitting element 22 can be directly connected to the wiring pattern 21*a*.

The upper surface (the light emission surface) of the light-emitting element 22 faces the front surface side of the vehicle luminaire 1. The light-emitting element 22 mainly emits light toward the front surface side of the vehicle luminaire 1. The number, size, arrangement, and the like of the light-emitting elements 22 are not limited to those illustrated and can be appropriately changed in response to the size, application, or the like of the vehicle luminaire 1.

The resistor 23 can be provided on the substrate 21. The resistor 23 can be electrically connected to the wiring pattern 21*a* provided on the surface of the substrate 21. The resistor 23 can be, for example, a surface mounted resistor, a resistor (metal oxide film resistor) having a lead wire, a film-shaped resistor formed using a screen printing method, or the like. Additionally, the resistor 23 illustrated in FIG. 1 is a film-shaped resistor.

As a material of the film-shaped resistor, for example, ruthenium oxide ($RuO_2$) can be used. The film-shaped resistor can be formed using, for example, a screen printing method and a baking method. If the resistor 23 is the film-shaped resistor, the contact area between the resistor 23 and the substrate 21 can be large and hence thermal radiation performance can be improved. Further, the plurality of resistors 23 can be formed at one time. For that reason, productivity can be improved. Further, it is possible to suppress a variation in the resistance value of the plurality of resistors 23.

Here, since there is a variation in the forward voltage characteristic of the light-emitting element 22, the brightness (light flux, luminance, luminous intensity, illuminance) of the light emitted from the light-emitting element 22 varies when the voltage applied between the anode terminal and the ground terminal is kept constant. For that reason, the value of the current flowing to the light-emitting element 22 can be set within a predetermined range by the resistor 23 so that the brightness of the light emitted from the light-emitting element 22 falls into a predetermined range. In this case, the value of the current flowing to the light-emitting element 22 can be set within a predetermined range by changing the resistance value of the resistor 23.

When the resistor 23 is a surface mounted resistor or a resistor with a lead wire, the resistor 23 having an appropriate resistance value in response to the forward voltage characteristics of the light-emitting element 22 can be selected. When the resistor 23 is a film-shaped resistor, the resistance value can be increased if a part of the resistor 23 is removed. For example, when the resistor 23 is irradiated with a laser beam, a part of the resistor 23 can be easily removed. The number, size, arrangement, and the like of the resistors 23 are not limited to those illustrated and can be appropriately changed in response to the number, specifications, and the like of the light-emitting elements 22.

The control element 24 can be provided on the substrate 21. The control element 24 can be electrically connected to the wiring pattern 21*a*. The control element 24 can be provided so that a reverse voltage is not applied to the light-emitting element 22 and a pulse noise is not applied to the light-emitting element 22 from a reverse direction. The control element 24 can be, for example, a diode. The control element 24 can be, for example, a surface mounted diode or a diode including a lead wire. The control element 24 illustrated in FIG. 1 is a surface mounted diode.

In addition, a pull-down resistor can also be provided in order to detect continuity for the light-emitting element 22 and prevent erroneous lighting. Further, a covering portion that covers the wiring pattern 21*a* or the film-shaped resistor can be provided. The covering portion can include, for example, a glass material.

When the light-emitting element 22 is the chip-shaped light-emitting element, the light-emitting module 20 can further include a frame 25 and a sealing portion 26.

The frame 25 can be bonded onto the substrate 21. The frame 25 can have a frame shape. At least one light-emitting element 22 can be provided in a region surrounded by the frame 25. For example, the frame 25 can surround the plurality of light-emitting elements 22. The frame 25 can be formed of a resin. The resin can be, for example, a thermoplastic resin such as polybutylene terephthalate (PBT), polycarbonate (PC), PET, Nylon, polypropylene (PP), polyethylene (PE), and polystyrene (PS).

Further, it is possible to improve the reflectance of the light emitted from the light-emitting element 22 by mixing particles of titanium oxide or the like in the resin. Additionally, the embodiment is not limited to the particles of titanium oxide and particles of a material having high reflectance with respect to the light emitted from the light-emitting element 22 may be mixed. Further, the frame 25 can be formed of, for example, a white resin. That is, the frame 25 can have a function of defining the formation range of the sealing portion 26 and a function of the reflector.

Additionally, a case in which the frame 25 is molded using an injection-molding method or the like and the molded frame 25 is bonded to the substrate 21 is illustrated, but the embodiment is not limited thereto. For example, the frame 25 can also be formed by applying a dissolved resin in a frame shape on the substrate 21 using a dispenser or the like and curing the resin.

Further, the frame 25 can be omitted. When the frame 25 is omitted, the dome-shaped sealing portion 26 covering the light-emitting element 22 can be provided. Additionally, when the frame 25 is provided, the formation range of the sealing portion 26 can be defined. For that reason, since it is possible to suppress an increase in the planar dimension of the sealing portion 26, it is possible to decrease the size of the substrate 21 and further decrease the size of the vehicle luminaire 1.

The sealing portion 26 can be provided in a region surrounded by the frame 25. The sealing portion 26 can be provided so as to cover the region surrounded by the frame 25. The sealing portion 26 can be provided so as to cover the light-emitting element 22. The sealing portion 26 can be formed of a material having translucency. For example, the sealing portion 26 can be formed by filling a resin into the region surrounded by the frame 25. The filling of the resin can be performed by, for example, liquid dispensing equipment such as a dispenser. The resin to be filled can be, for example, a silicone resin. Further, the sealing portion 26 can include a phosphor. The phosphor can be, for example, a YAG phosphor (yttrium.aluminum.garnet phosphor). However, the type of the phosphor can be appropriately changed so that a predetermined emission color can be obtained according to the application of the vehicle luminaire 1 or the like.

Additionally, when the light-emitting element 22 is a surface mounted light-emitting element or a shell type light-emitting element having a lead wire, the frame 25 and the sealing portion 26 can be omitted. However, as described above, the light-emitting element 22 is desirably the chip-shaped light-emitting element and the frame 25 and the sealing portion 26 are desirably provided in consideration of a decrease in size of the substrate 21.

A plurality of the power-supply terminals 30 can be provided. The plurality of power-supply terminals 30 can be provided inside the socket 10. The plurality of power-supply terminals 30 can be bar-shaped bodies. The plurality of power-supply terminals 30 can protrude from the bottom surface 11*a*1 of the concave portion 11*a* and be soldered to the wiring pattern 21*a* provided on the substrate 21. An end portion on the side of the thermal radiation fin 14 of the plurality of power-supply terminals 30 can be exposed into the connector holder 15. The connector 105 can be fitted to the plurality of power-supply terminals 30 exposed into the connector holder 15. The plurality of power-supply terminals 30 can be formed of, for example, metal such as a copper alloy. Additionally, the number, shape, arrangement, material, and the like of the power-supply terminals 30 are not limited to those illustrated, but can be appropriately changed.

As described above, the socket 10 is desirably formed of a material having high heat conductivity. Incidentally, the material having high heat conductivity may have electrical conductivity. For example, a metal or a high thermal conductive resin including a filler formed of carbon has conductivity. For that reason, an insulation portion can be provided between the plurality of power-supply terminals 30 and the socket 10 in the case of the socket 10 having conductivity. Additionally, when the socket 10 is formed of a high thermal conductive resin having insulation properties (for example, a high thermal conductive resin or the like including a ceramic filler), the insulation portion can be omitted. In this case, the socket 10 holds the plurality of power-supply terminals 30.

Next, the light extraction portion 11*b* provided in the attachment portion 11 will be described further.

As described above, the upper surface (the light emission surface) of the light-emitting element 22 faces the front surface side of the vehicle luminaire 1. For that reason, the light-emitting element 22 generally emits light toward the front surface side of the vehicle luminaire 1. However, a part of the light emitted from the light-emitting element 22 is applied to the inner wall side of the concave portion 11*a*. In this case, when the light is incident on the inner wall surface of the concave portion 11*a*, a part of the incident light is not reflected, but is absorbed by the inner wall surface. Since the light absorbed by the inner wall surface cannot be extracted to the outside of the vehicle luminaire 1, the light extracting efficiency is deteriorated by the corresponding amount.

Here, the vehicle luminaire 1 according to the embodiment is provided with the attachment portion 11 having the light extraction portion 11*b*. As described above, the light extraction portion 11*b* penetrates between the inner wall surface of the concave portion 11*a* and the outer side surface 11*c* of the attachment portion 11. For that reason, the light applied to the light extraction portion 11*b* is not absorbed by the inner wall surface of the concave portion 11*a*, but is applied to the outside of the vehicle luminaire 1 through the light extraction portion 11*b*. That is, the light extracting efficiency can be improved. Since the light applied to the outside of the vehicle luminaire 1 through the light extraction portion 11*b* can be incident on, for example, the optical element 103 provided in the vehicle lamp 100, it is possible to effectively use the light.

Here, when the depth of the concave portion 11*a* is shallow, the amount of the light that can be extracted to the outside of the vehicle luminaire 1 can be increased. However, when the depth of the concave portion 11*a* is too shallow, there is concern that the element provided on the light-emitting module 20 may be exposed from the end face of the attachment portion 11. That is, there is concern that the light-emitting module 20 cannot be protected.

In this case, as illustrated in FIGS. 1 and 2, in a portion 11*c*1 provided with the bayonet 12 in the circumferential direction of the attachment portion 11, a distance H1 between the bottom surface 11*a*1 of the concave portion 11*a* and an end portion on the side of the bottom surface 11*a*1 of the light extraction portion 11*b* can be set to be smaller than a distance H2 between the bottom surface 11*a*1 of the concave portion 11*a* and a top portion of the sealing portion 26. In this way, the light extracting efficiency can be improved.

Further, in a portion not provided with the bayonet 12 in the circumferential direction of the attachment portion 11, a distance H3 between the bottom surface 11*a*1 of the concave portion 11*a* and an end face having the concave portion 11*a* opening thereto in the attachment portion 11 can be set to be larger than the distance H2 between the bottom surface 11*a*1 of the concave portion 11*a* and the top portion of the sealing portion 26. In this way, the light-emitting module 20 can be protected.

Additionally, in the portion 11*c*1 provided with the bayonet 12 in the circumferential direction of the attachment portion 11, the distance H1 between the bottom surface 11*a*1 of the concave portion 11*a* and the end portion on the side of the bottom surface 11*a*1 of the light extraction portion 11*b* can be set to be equal to, slightly larger, or slightly smaller than a distance H4 between the bottom surface 11*a*1 of the concave portion 11*a* and an upper surface 12*a* of the bayonet 12 (an end face on the side of the opening of the concave portion 11*a* in the bayonet 12). That is, an end portion on the side of the bottom surface 11*a*1 in the light extraction portion 11*b* can be provided in the vicinity of the upper surface of the bayonet 12. Additionally, in the case illustrated in FIG. 2, the distance H1 is equal to the distance H4. According to a positional relationship between the end portion on the side of the bottom surface 11*a*1 in the light extraction portion 11*b* and the upper surface 12*a* of the bayonet 12, the light extracting efficiency can be further improved.

Figure 3:
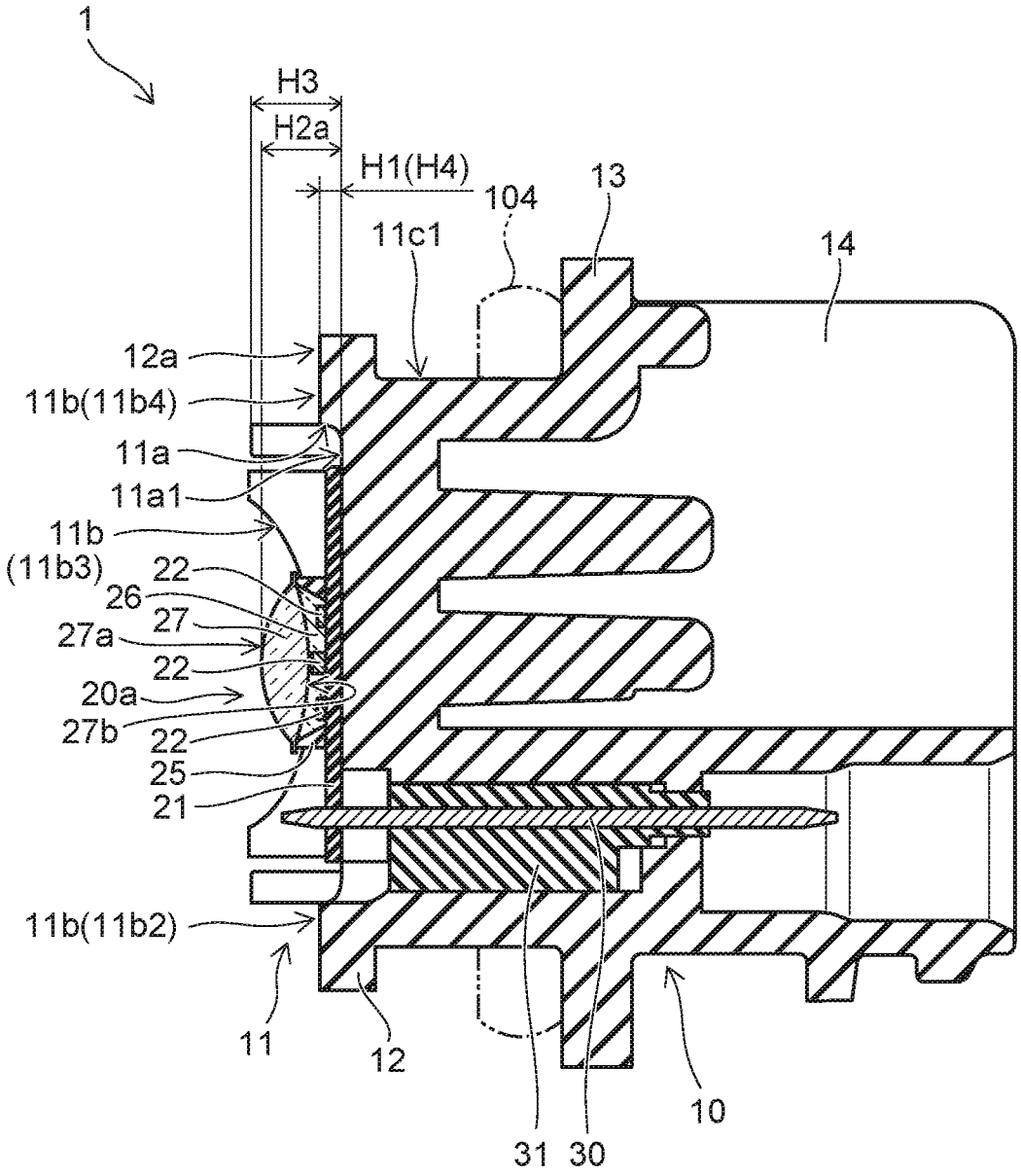
FIG. 3 is a schematic cross-sectional view illustrating a light-emitting module according to another embodiment.

FIG. 3 is a schematic cross-sectional view illustrating a light-emitting module 20*a* according to another embodiment.

As illustrated in FIG. 3, the light-emitting module 20*a* can include the substrate 21, the light-emitting element 22, the resistor 23, the control element 24, the frame 25, the sealing portion 26, and an optical element 27.

The optical element 27 is configured to obtain a predetermined light distribution characteristic by diffusing the light emitted from the light-emitting element 22. The optical element 27 can be, for example, a convex lens. Additionally, the optical element 27 may be, for example, a concave lens or the like. Herein, a case in which the optical element 27 is the convex lens will be exemplified as an example.

The optical element 27 can be formed of a translucent material. For example, the optical element 27 can be formed of a translucent resin such as a silicone resin and an acrylic resin or glass. The optical element 27 can be formed by, for example, an injection-molding method or a molding method.

The optical element 27 can be provided on the frame 25. For example, the optical element 27 can be provided in an end face opposite to the substrate 21 in the frame 25. The optical element 27 can be bonded to at least one of the end face opposite to the substrate 21 in the sealing portion 26 and the end face opposite to the substrate 21 in the frame 25.

A surface (light emission surface) 27*a* opposite to the substrate 21 in the optical element 27 corresponding to the convex lens can be a curved surface which protrudes toward the side opposite to the substrate 21. The surface 27*a* can be, for example, a part of a spherical surface. A surface (light incident surface) 27*b* on the side of the substrate 21 in the optical element 27 can be a curved surface which protrudes toward the substrate 21. The surface 27*b* can be, for example, a part of a spherical surface. The surface 27*b* can be an inclined surface which is inclined in a direction moving close to the surface 27*a* as it goes toward the peripheral edge. The center of the surface 27*a* of the optical element 27 and the center of the surface 27*b* can be provided on the line.

When the optical element 27 is provided on the frame 25, the positional relationship can be set as below.

For example, as illustrated in FIG. 3, in the portion 11*c*1 provided with the bayonet 12 in the circumferential direction of the attachment portion 11, the distance H1 between the bottom surface 11*a*1 of the concave portion 11*a* and the end portion on the side of the bottom surface 11*a*1 in the light extraction portion 11*b* can be set to be smaller than a distance H2*a* between the bottom surface 11*a*1 of the concave portion 11*a* and the top portion of the optical element 27. In this way, the light extracting efficiency can be improved.

Further, in the portion not provided with the bayonet 12 in the circumferential direction of the attachment portion 11, the distance H3 between the bottom surface 11*a*1 of the concave portion 11*a* and the end face having the concave portion 11*a* opening thereto in the attachment portion 11 can be set to be larger than a distance H2*a* between the bottom surface 11*a*1 of the concave portion 11*a* and the top portion of the optical element 27. In this way, the light-emitting module 20 can be protected.

Figure 4A:
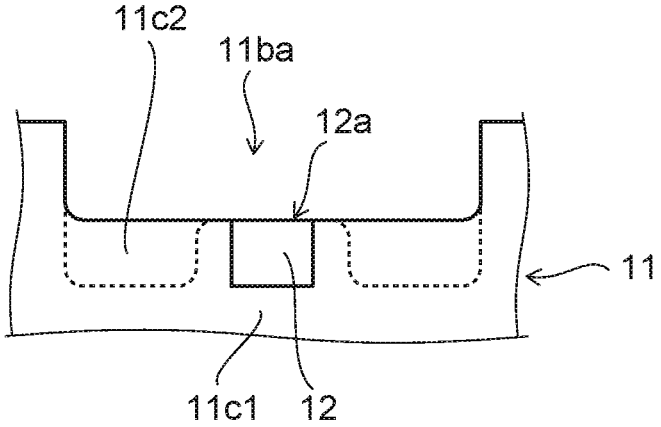
FIGS. 4A to 4C are schematic views illustrating a shape of a light extraction portion.
Figure 4B:
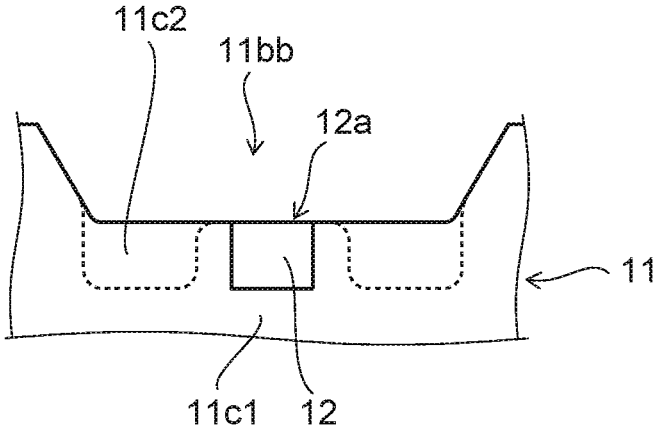
Figure 4C:
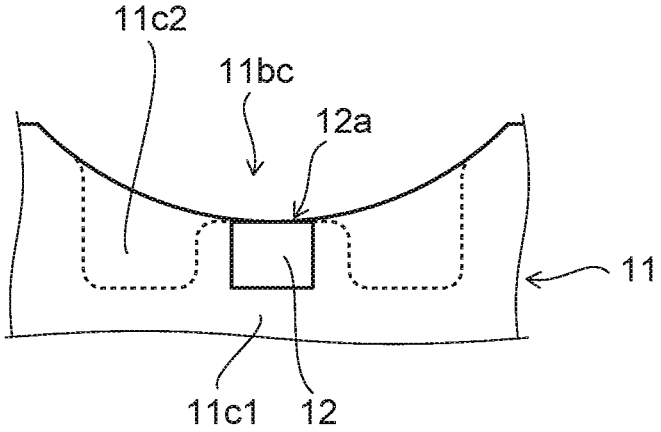

FIGS. 4A to 4C are schematic views illustrating a shape of the light extraction portion.

As illustrated in FIGS. 4A and 4B, light extraction portions 11*ba* and 11*bb* each mainly having a linear shape can be used. As illustrated in FIG. 4C, a light extraction portion 11*bc* mainly having a curved shape can be used. In this case, it is easy to improve the light extracting efficiency in a shape in which the size of the light extraction portion increases. Meanwhile, it is possible to suppress deterioration of the strength of the attachment portion 11 when the end portion of the light extraction portion in the circumferential direction is provided with an inclined surface or a round surface. For example, in the light extraction portion 11*ba* having a shape illustrated in FIG. 4A, it is easy to improve the light extracting efficiency. For example, in the light extraction portions 11*bb* and 11*bc* illustrated in FIGS. 4B and 4C, it is possible to suppress deterioration of the strength of the attachment portion 11.

Further, as illustrated in FIGS. 4A to 4C, in a portion 11*c*2 not provided with the bayonet 12 in the circumferential direction of the attachment portion 11, a distance between the bottom surface 11*a*1 of the concave portion 11*a* and an end portions on the side of the bottom surface 11*a*1 in each of the light extraction portions 11*ba*, 11*bb*, and 11*bc* can be set to be smaller than a distance between the bottom surface 11*a*1 of the concave portion 11*a* and the upper surface 12*a* of the bayonet 12. In this way, the light extracting efficiency can be further improved.

Figure 5A:
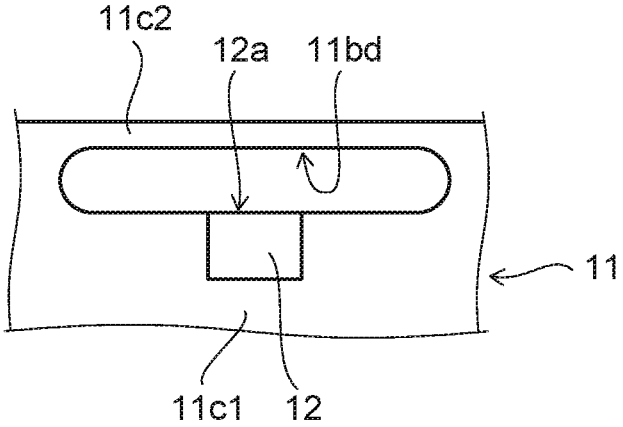
FIGS. 5A to 5C are schematic views illustrating a light extraction portion according to another embodiment.
Figure 5B:
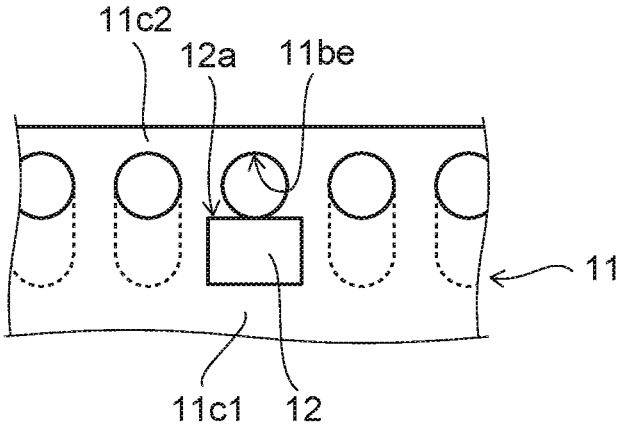
Figure 5C:
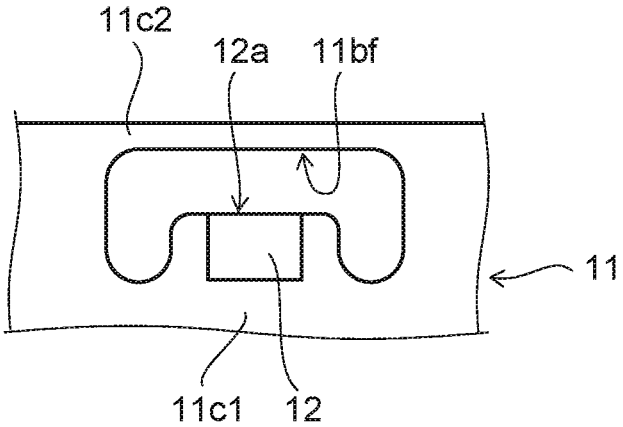

FIGS. 5A to 5C are schematic views illustrating a light extraction portion according to another embodiment.

The light extraction portions 11*b*1 to 11*b*2, 11*ba*, 11*bb*, and 11*bc* also open to the end face having the concave portion 11*a* opening thereto in the attachment portion 11. That is, the light extraction portions 11*b*1 to 11*b*2, 11*ba*, 11*bb*, and 11*bc* can be the concave portion opening to the end face having the concave portion 11*a* opening thereto in the attachment portion 11.

On the contrary, light extraction portions 11*bd*, 11*be*, and 11*bf* illustrated in FIGS. 5A to 5C can be holes penetrating between the inner wall surface of the concave portion 11*a* and the outer side surface 11*c* of the attachment portion 11. In this case, since the light applied to the light extraction portions 11*bd*, 11*be*, and 11*bf* is not absorbed by the inner wall surface of the concave portion 11*a*, but is applied to the outside of the vehicle luminaire 1, the light extracting efficiency can be improved. Since the light applied to the outside of the vehicle luminaire 1 through the light extraction portions 11*bd*, 11*be*, and 11*bf* can be incident on, for example, the optical element 103 provided in the vehicle lamp 100, the light can be effectively used.

In this case, as illustrated in FIGS. 5A to 5C, the light extraction portions 11*bd*, 11*be*, and 11*bf* can be allowed not to open to the end face having the concave portion 11*a* opening thereto in the attachment portion 11. In this way, it is possible to suppress deterioration of the strength of the attachment portion 11.

The shape or number of the light extraction portions corresponding to the through-holes can be appropriately changed in response to the size of the attachment portion 11, the required light extracting efficiency, the required strength of the attachment portion 11, and the like.

Additionally, in the portion 11*c*1 provided with the bayonet 12 in the circumferential direction of the attachment portion 11, a positional relationship between the end portion on the side of the bottom surface 11*a*1 of the light extraction portion corresponding to the through-hole and the upper surface 12*a* of the bayonet 12 can be set similarly to the case of the light extraction portion having a concave shape. That is, a distance between the bottom surface 11*a*1 of the concave portion 11*a* and the end portion on the side of the bottom surface 11*a*1 of each of the light extraction portions 11*bd* and 11*be* can be set to be equal to, slightly larger, or slightly smaller than a distance between the bottom surface 11*a*1 of the concave portion 11*a* and the upper surface 12*a* of the bayonet 12. That is, the end portion on the side of the bottom surface 11*a*1 of each of the light extraction portions 11*bd* and 11*be* can be provided in the vicinity of the upper surface of the bayonet 12. Additionally, although it is illustrated in FIGS. 5A to 5C, the end portion on the side of the bottom surface 11*a*1 of each of the light extraction portions 11*bd* and 11*be* is provided at the position of the upper surface 12*a* of the bayonet 12.

Further, as illustrated in FIGS. 5A to 5C, in a portion 11*c*2 not provided with the bayonet 12 in the circumferential direction of the attachment portion 11, a distance between the bottom surface 11*a*1 of the concave portion 11*a* and the end portion on the side of the bottom surface 11*a*1 of each of the light extraction portions 11*ba*, 11*bb*, and 11*bc* can be set to be smaller than a distance between the bottom surface 11*a*1 of the concave portion 11*a* and the upper surface 12*a* of the bayonet 12. In this way, the light extracting efficiency can be further improved.

If the light extraction portion is the through-hole, the strength of the attachment portion 11 can be set to be larger than that of the light extraction portion having a concave shape. Meanwhile, in the light extraction portion having a concave shape, the light extracting efficiency can be improved compared to the light extraction portion corresponding to the through-hole. For that reason, the form of the light extraction portion can be appropriately determined in response to, for example, the required light extracting efficiency, the required strength of the attachment portion 11, and the like.

(Vehicle Lamp)

Next, the vehicle lamp 100 will be illustrated.

Additionally, hereinafter, a case in which the vehicle lamp 100 is a front combination light provided in an automobile will be described as an example. However, the vehicle lamp 100 is not limited to the front combination light provided in the automobile. The vehicle lamp 100 may be a vehicle lamp provided in an automobile, a railway car or the like.

Figure 6:
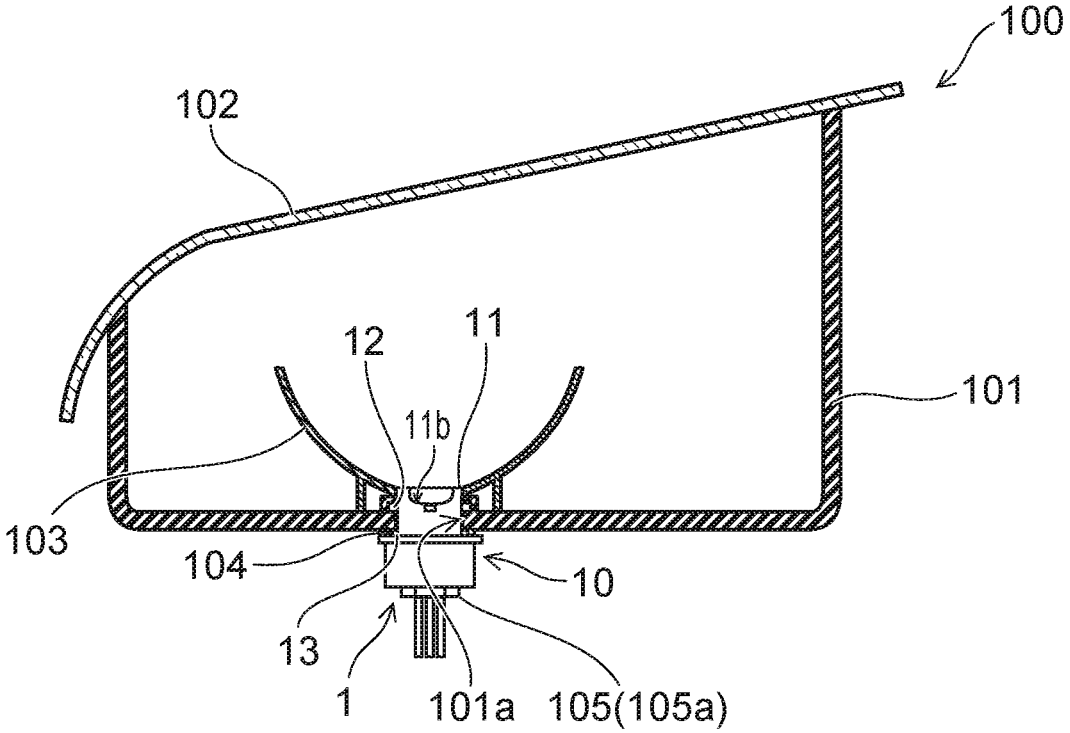
FIG. 6 is a partially cross-sectional view schematically illustrating a vehicle lamp.

FIG. 6 is a partially cross-sectional view schematically illustrating the vehicle lamp 100.

As illustrated in FIG. 6, the vehicle lamp 100 can be provided with the vehicle luminaire 1, the casing 101, a cover 102, an optical element 103, a seal member 104, and the connector 105.

The vehicle luminaire 1 can be attached to the casing 101. The casing 101 can hold the attachment portion 11. The casing 101 can have a box shape of which one end portion side is opened. The casing 101 can be formed of, for example, a resin that does not transmit light. The bottom surface of the casing 101 can be provided with the attachment hole 101*a* into which a portion provided with the bayonet 12 is inserted in the attachment portion 11. The peripheral edge of the attachment hole 101*a* can be provided with a concave portion into which the bayonet 12 provided on the attachment portion 11 is inserted. Additionally, a case in which the attachment hole 101*a* is directly provided in the casing 101 is illustrated, but an attachment member with the attachment hole 101*a* may be provided in the casing 101.

At the time of attaching the vehicle luminaire 1 to the vehicle lamp 100, a portion provided with the bayonet 12 on the attachment portion 11 is inserted into the attachment hole 101*a* and the vehicle luminaire 1 is rotated. Then, for example, the bayonet 12 is held by a fitting portion provided in the peripheral edge of the attachment hole 101*a*. Such an attachment method is called a twist lock.

The cover 102 can be provided so as to block the opening of the casing 101. The cover 102 can be formed of a resin having translucency. The cover 102 can have a function of a lens or the like.

Light emitted from the vehicle luminaire 1 is incident on the optical element 103. The optical element 103 can perform a reflecting operation, a diffusing operation, a guiding operation, a collecting operation, and a predetermined light distribution pattern forming operation of the light emitted from the vehicle luminaire 1. For example, the optical element 103 illustrated in FIG. 6 is a reflector. In this case, the optical element 103 can form a predetermined light distribution pattern by reflecting light emitted from the vehicle luminaire 1.

As described above, since the attachment portion 11 is provided with the light extraction portion 11*b*, it is possible to decrease the amount of the light absorbed by the inner wall of the concave portion 11*a*. Further, the light applied to the outside of the vehicle luminaire 1 through the light extraction portion 11*b* can be incident on the optical element 103. For that reason, it is possible to effectively use the light applied from the light-emitting element 22.

The seal member 104 can be provided between the flange 13 and the casing 101. The seal member 104 can have an annular shape. The seal member 104 can be formed of an elastic material such as rubber or silicone resin.

When the vehicle luminaire 1 is attached to the vehicle lamp 100, the seal member 104 is sandwiched between the flange 13 and the casing 101. For that reason, the internal space of the casing 101 can be sealed by the seal member 104. Further, the bayonet 12 is pressed against the casing 101 by the elastic force of the seal member 104. For that reason, it is possible to suppress the vehicle luminaire 1 from being separated from the casing 101.

The connector 105 can be fitted to the end portions of the plurality of power-supply terminals 31 exposed into the connector holder 15. A power supply (not illustrated) or the like can be electrically connected to the connector 105. For that reason, the light-emitting element 22 can be electrically connected to a power supply (not illustrated) or the like by fitting the connector 105 to the end portions of the plurality of power-supply terminals 31.

Further, the connector 105 can be provided with the seal member 105*a*. The inside of the connector holder 15 is sealed so as to be watertight in such a manner that the connector 105 with the seal member 105*a* is inserted into the connector holder 15. The seal member 105*a* can be formed in an annular shape from an elastic material such as rubber or silicone resin.

What is claimed is:

1. A vehicle luminaire comprising:

an attachment portion which includes a concave portion opening to one end face;

a light-emitting module which includes a substrate, at least one light-emitting element provided in the substrate, and a sealing portion covering the light-emitting element, the sealing portion being provided inside the concave portion; and a plurality of bayonets which are provided on an outer side surface of the attachment portion, the attachment portion including at least one light extraction portion which penetrates between an inner wall surface of the concave portion and the outer side surface of the attachment portion, in a portion provided with at least one of the bayonets in a circumferential direction of the attachment portion, a distance between a bottom surface of the concave portion and an end portion on the side of the bottom surface of the light extraction portion being smaller than a distance between the bottom surface and a top portion of the sealing portion, and in a portion not provided with any of the bayonets in the circumferential direction of the attachment portion, a distance between the bottom surface and an end face having the concave portion opening thereto in the attachment portion is larger than a distance between the bottom surface and the top portion of the sealing portion.

2. The luminaire according to claim 1, wherein the light-emitting module further includes a frame which surrounds the light-emitting element and the sealing portion and a first optical element which is provided on the frame, and in the portion provided with any of the bayonets in the circumferential direction of the attachment portion, a distance between the bottom surface of the concave portion and an end portion on the side of the bottom surface in the light extraction portion is smaller than a distance between the bottom surface and a top portion of the first optical element.

3. The luminaire according to claim 2, wherein in a portion not provided with any of the bayonets in the circumferential direction of the attachment portion, a distance between the bottom surface and an end face having the concave portion opening thereto in the attachment portion is larger than a distance between the bottom surface and the top portion of the first optical element.

4. The luminaire according to claim 1, wherein in a portion not provided with any of the bayonets in the circumferential direction of the attachment portion, a distance between the bottom surface and an end portion on the side of the bottom surface in the light extraction portion is smaller than a distance between the bottom surface and an upper surface of the bayonets.

5. The luminaire according to claim 1, wherein in a portion not provided with any of the bayonets of the attachment portion, a distance between the bottom surface and an end portion on the side of the bottom surface in the light extraction portion is equal to a distance between the bottom surface and an upper surface of the bayonets.

6. The luminaire according to claim 1, wherein the light extraction portion has a linear shape.

7. The luminaire according to claim 1, wherein the light extraction portion has a curved shape.

8. The luminaire according to claim 1, wherein an inclined surface or a round surface is provided in an end portion of the light extraction portion in the circumferential direction of the attachment portion.

9. The luminaire according to claim 1, wherein the light extraction portion further opens to an end face of the attachment portion in which the concave portion opens.

10. The luminaire according to claim 1, wherein the light extraction portion does not open to an end face of the attachment portion in which the concave portion opens.

11. The luminaire according to claim 10, wherein the light extraction portion is a through-hole.

12. The luminaire according to claim 10, wherein in the portion provided with the at least one of the bayonets in the circumferential direction of the attachment portion, a distance between the bottom surface and an end portion on the side of the bottom surface in the light extraction portion is equal to a distance between the bottom surface and an upper surface of the at least one of the bayonets.

13. The luminaire according to claim 1, wherein the attachment portion further includes at least one slit which is provided to be separated from the light extraction portion and accommodates a corner portion of the substrate.

14. The luminaire according to claim 1, wherein the plurality of chip-shaped light-emitting elements are provided in a center region of the substrate, and a part of light applied from the plurality of light-emitting elements is applied to the outside of the vehicle luminaire through the light extraction portion.

15. The luminaire according to claim 1, wherein the sealing portion includes a resin having translucency and a phosphor.

16. The luminaire according to claim 2, wherein the first optical element is a convex lens.

17. The luminaire according to claim 1, wherein the attachment portion and the plurality of bayonets are integrally formed and include a high thermal conductive resin.

18. A vehicle lamp comprising:

the vehicle luminaire according to claim 1; and a casing to which the vehicle luminaire is attached.

19. The lamp according to claim 18, further comprising a second optical element on which light applied from the vehicle luminaire is to be incident, wherein the vehicle luminaire is provided with an attachment portion including at least one light extraction portion, and light applied to the outside of the vehicle luminaire through the light extraction portion is incident on the second optical element.

20. A vehicle luminaire comprising:

an attachment portion which includes a concave portion opening to one end face;

a light-emitting module which includes a substrate, at least one light-emitting element provided in the substrate, a sealing portion covering the light-emitting element, a frame which surrounds the light-emitting element and the sealing portion, and a first optical element which is provided on the frame and is provided inside the concave portion; and a plurality of bayonets which are provided on an outer side surface of the attachment portion, the attachment portion including at least one light extraction portion which penetrates between an inner wall surface of the concave portion and the outer side surface of the attachment portion, in a portion provided with at least one of the bayonets in a circumferential direction of the attachment portion, a distance between a bottom surface of the concave portion and an end portion on the side of the bottom surface of the light extraction portion being smaller than a distance between the bottom surface and a top portion of the sealing portion, and in the portion provided with the at least one of the bayonets in the circumferential direction of the attachment portion, a distance between the bottom surface of the concave portion and an end portion on the side of the bottom surface in the light extraction portion is smaller than a distance between the bottom surface and a top portion of the first optical element.

21. The luminaire according to claim 20, wherein in a portion not provided with any of the bayonets in the circumferential direction of the attachment portion, a distance between the bottom surface and an end face having the concave portion opening thereto in the attachment portion is larger than a distance between the bottom surface and the top portion of the first optical element.

* * * * *